US006779614B2

(12) United States Patent
Oser

(10) Patent No.: US 6,779,614 B2
(45) Date of Patent: Aug. 24, 2004

(54) SYSTEM AND METHOD FOR TRANSFERRING PIPE

(75) Inventor: Michael S. Oser, Plano, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 52 days.

(21) Appl. No.: 10/080,137

(22) Filed: Feb. 21, 2002

(65) Prior Publication Data

US 2003/0155154 A1 Aug. 21, 2003

(51) Int. Cl.[7] ..... E21B 19/20

(52) U.S. Cl. ..... 175/85; 175/52; 166/85.1

(58) Field of Search ..... 175/52, 85, 162, 175/220; 166/85.1; 414/22.54–22.58, 22.62, 22.61

(56) References Cited

U.S. PATENT DOCUMENTS

| | | | | |
|---|---|---|---|---|
| 4,382,591 A | * | 5/1983 | Minnis et al. | 269/156 |
| 4,547,110 A | | 10/1985 | Davidson | 414/22 |
| 4,586,572 A | | 5/1986 | Myers et al. | 175/85 |
| 4,591,006 A | | 5/1986 | Hutchison et al. | 175/52 |
| 4,610,315 A | | 9/1986 | Koga et al. | 175/85 |
| 5,451,129 A | * | 9/1995 | Boyadjieff et al. | 414/22.61 |
| 5,458,454 A | | 10/1995 | Sorokan | 414/786 |
| 6,068,066 A | | 5/2000 | Byrt et al. | 173/4 |
| 6,343,662 B2 | | 2/2002 | Byrt et al. | 173/4 |

* cited by examiner

*Primary Examiner*—Zakiya Walker
(74) *Attorney, Agent, or Firm*—John W. Wustenberg; Warren B. Kice

(57) ABSTRACT

A system and method for transferring pipe according to which a pipe joint is positioned in a pipe lift in a first position and moved to a second position before being transferred from the pipe lift to a pipe shuttle and moved to a third position.

7 Claims, 7 Drawing Sheets

SYSTEM AND METHOD FOR TRANSFERRING PIPE

BACKGROUND

This invention relates to a system and method for transferring pipe between a storage device for the pipe and a pipe string extending over a well.

Hydraulic workover units for transferring pipe between a storage device and a pipe string extending over a well, or the like, are well known. These units traditionally have been limited to a series of winches and associated equipment, requiring heavy manual labor to deliver the pipe, via the winches, from a pipe rack to an elevated position for lowering into a work basket, or the like, for introduction into the well, and visa versa. Therefore, what is needed is a more automatic system that reduces the manual labor and the time involved in these type of operations.

DETAILED DESCRIPTION

Figure 1:
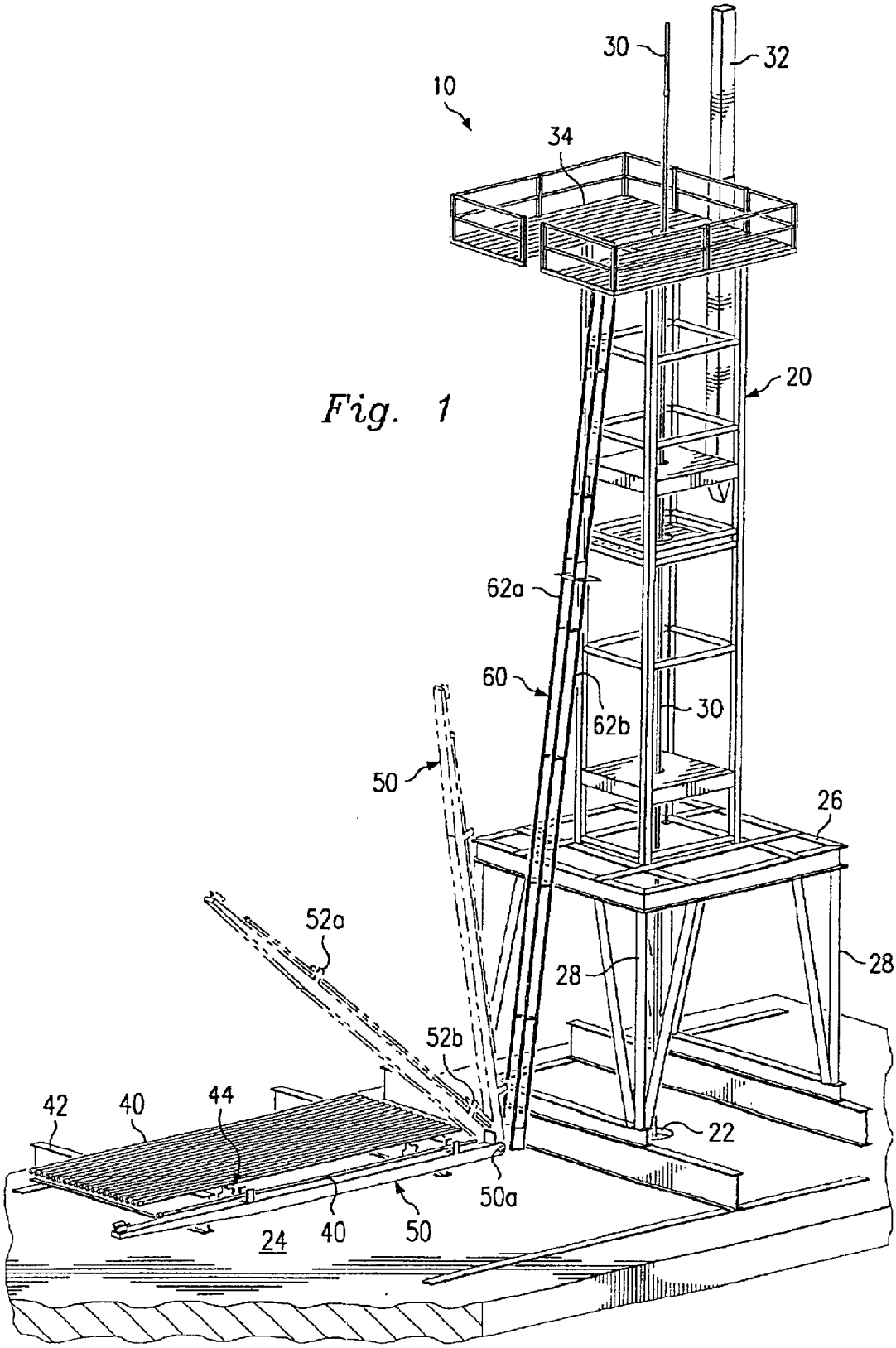
FIG. 1 is an isometric view of a system for transferring pipe according to an embodiment of the invention.
Figure 2:
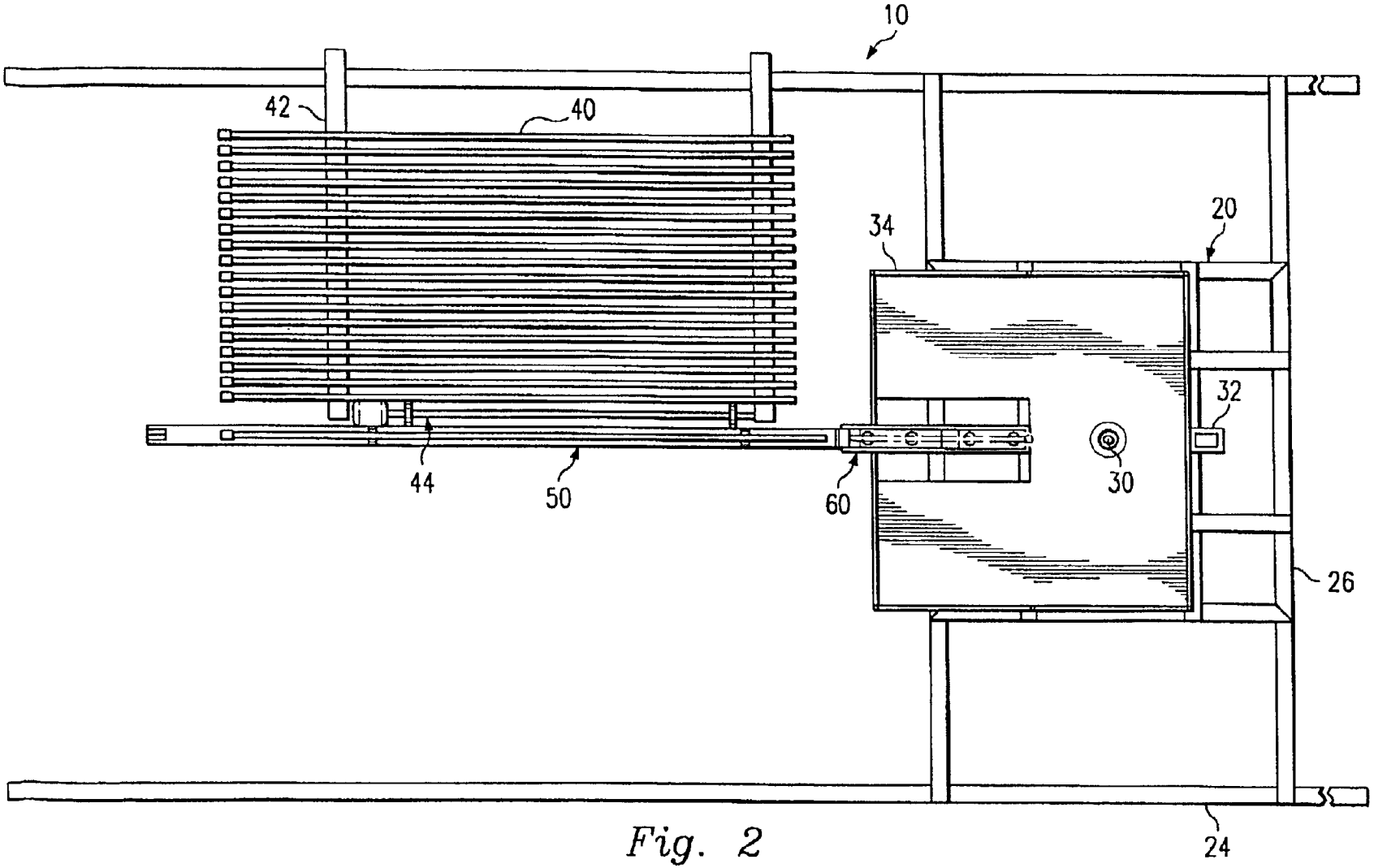
FIG. 2 is a top plan view of the system of FIG. 1.

Referring to FIGS. 1 and 2 of the drawings, the reference numeral 10 refers, in general, to a system for transferring pipe which is designed to operate in conjunction with a tower 20. The tower 20 is designed to allow various drilling or workover operations to be performed on a well 22 which well may be an oil, a gas, or another type of well located onshore or offshore. For example, a typical operation of this type would be a snubbing operation according to which a plurality of tubulars, such as pipes, pipe joints, etc. are run into or out of the well 22.

A deck 24 surrounds the well 22 and includes a platform 26 supported in a vertically spaced relation to the well 22 and the deck 24 by a plurality of support members 28. The tower 20 is formed by a plurality of additional support members, or beams, extending substantially vertically from the platform 26, along with several horizontal support members, or beams, attached to the vertical members. Since the tower 20 is conventional and does not, per se, form any part of the present invention, many details of the tower have been omitted in the interest of clarity.

The tower 20 and the platform 26 accommodate a substantially vertically extending pipe string 30 which passes through suitable openings formed in the tower 20 and the platform 26. To this end, a mast 32 (shown partially in FIG. 1) is supported on the tower 20 and operates in a conventional manner to engage the pipe string 30 to enable it to be raised and lowered through the tower 20 and the well 22 in a conventional manner. A work basket 34 is attached to the tower 20 to permit various operations on the pipe string 30, such as joining additional pipe joints to, and removing pipe joints from, the pipe string 30, as will be described.

A plurality of pipe joints 40 are supported on a horizontally-extending rack 42 disposed adjacent the tower 20, and the system 10 operates to engage a pipe joint 40 from the rack 42 and transfer it to the work basket 34 for attaching to the pipe string 30; and to transfer a pipe joint 40 from the pipe string 30 to the rack 42, in a manner to be described.

A pipe feeder 44 is disposed on one side of the rack 42 for receiving the pipe joints 40 from the rack 42. The pipe feeder 44 is shown partially in FIGS. 1 and 2 and details will be described later. The pipe feeder 44 functions to feed the pipe joints 40 between the rack 42 and a pipe lift 50 mounted for pivotal movement on the platform 26. The pipe lift 50 is adapted to transfer the pipe joints 40 between the rack 42 and a shuttle 60 which is supported by the tower 20, and the shuttle 60, in turn, is adapted to transfer the pipe joints 40 between the pipe lift 50 and the work basket 34. The pipe lift 50 and the shuttle 60 will also be described in detail later.

Figure 3A:
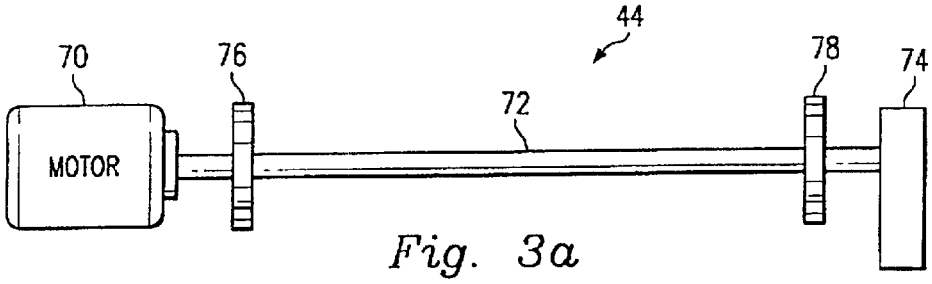
FIG. 3*a* is a diagrammatic view of a pipe feeder of the system of FIG. 1.
Figure 3B:
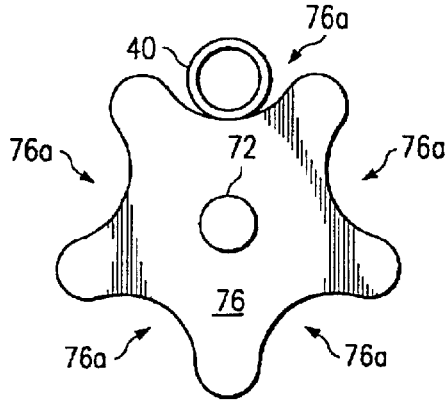
FIG. 3*b* is an elevational view of a component of the pipe feeder of FIG. 3*a*.

Details of the pipe feeder 44 are shown in FIGS. 3*a* and 3*b*. The pipe feeder 44 includes a motor 70 configured to drive a shaft 72 which is supported between the motor 70 at one end and a bearing 74 at the other end. Star wheels 76 and 78 are disposed on the shaft 72 in a spaced relation for rotation with the shaft 72, and the details of the star wheel 76 are shown in FIG. 3*b*. More particularly, the outer circumference of the star wheel 76 is configured to define five angular-spaced recessed portions 76*a*, each of which is adapted to receive a pipe joint 40 as shown, for example, in connection with one of the recessed portions 76*a* in FIG. 3*b*. It is understood that the star wheel 78 is identical to the star wheel 76, and the design is such that a pipe joint 40 will be received by corresponding recessed portions of both star wheels 76 and 78.

Thus, the pipe feeder 44 can function to transfer a pipe joint 40 from the rack 42 to the pipe lift 50. In this context, it is assumed that the pipe joints 40 are stacked, or otherwise arranged on the rack 42 so that they can sequentially fall from the rack 42 to the pipe feeder 44. The motor 70 is activated to rotate the shaft 72 to allow a pipe joint 40 from the rack 42 to be received in the recessed portion 76*a* of the star wheel 76 and the corresponding recessed portion of the star wheel 78. After a pipe joint 40 is received, continual rotation of the motor 70 causes the pipe joint 40 to move angularly relative to the shaft 72 until it rolls out of the recessed portion 76*a* and the corresponding recessed portion of the star wheel 78 and into pipe lift 50. The motor 70 then pauses until the pipe lift 50 is ready to receive another pipe joint 40 and the operation can be repeated.

Also, the pipe feeder 44 can function to rotate the shaft 72 to transfer a pipe joint 40 from the pipe lift 50 to the rack 42. In this mode, the motor 70 rotates the shaft 72 in a direction that is opposite to the direction of rotation in the previous mode to allow a pipe joint 40 from the pipe lift 50 to be received in one of the recessed portions 76*a* of the star wheel 76 and the corresponding recessed portion of the star wheel 78. After a pipe joint 40 is received, continual rotation of the motor 70 causes the pipe joint 40 to move angularly relative to the shaft 72 until it rolls out of the recessed portion 76*a* of the star wheel 76 and the corresponding recessed portion of the star wheel 78 and onto the rack 42. The motor 70 is then paused until the pipe lift 50 is ready to provide another pipe joint 40 and the operation is repeated.

As shown in FIGS. 1 and 2, one end is the pipe lift 50 is pivotally mounted to the deck 24 about a hinge 50*a*, and a pair of pipe grips 52*a* and 52*b* are mounted in a spaced relation on the pipe lift 50. It is understood that the pipe grips 52*a* and 52*b* are adapted to be actuated to move into and from a position in which they grip the pipe joint 40, in a conventional manner. The pipe lift 50 moves between a substantially horizontal position shown by the solid lines in FIG. 1 in which a pipe joint 40 is transferred between the pipe lift 50 and the rack 42, through an intermediate position shown by the phantom lines, and to an upright position extending at a slight angle to the vertical, also shown by the phantom lines. In the last position, the pipe lift 50 is adjacent the shuttle 60 so that a pipe joint 40 can be transferred between the pipe lift 50 and the shuttle 60. It is understood that a conventional hydraulic cylinder, or the like, (not shown) is provided to pivot the pipe lift 50 about the hinge 50*a* between the above positions.

After the pipe joint 40 from the rack 42 is grasped by the pipe grips 52*a* and 52*b* and the pipe lift 50 is pivoted to transfer the pipe joint 40 to the shuttle 60, the pipe joint 40 is released to the shuttle 60 by releasing the pipe grips 52*a* and 52*b*. Likewise, when the pipe joint 40 from the shuttle 60 is grasped by the pipe grips 52*a* and 52*b* and the pipe lift 50 is pivoted to transfer the pipe joint 40 to the rack 42, the pipe joint 40 is released to the shuttle 60 by releasing the pipe grips 52*a* and 52*b*.

The shuttle 60 moves vertically along a set of rails 62*a* and 62*b* supported by the tower 20, with the movement being between a lower position shown in FIG. 1 in which the shuttle 60 receives a pipe joint 40 from, or transfers a pipe joint 40 to, the pipe lift 50; and an upper position in which it receives a pipe joint 40 from, or transfers a pipe joint 40 to, an operator in the work basket 34.

Figure 4:
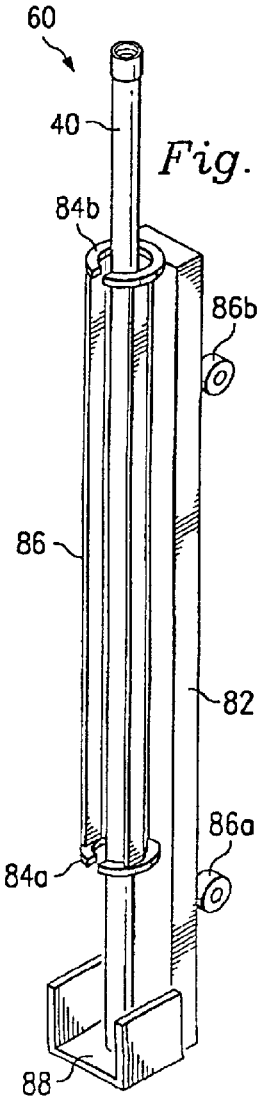
FIG. 4 is an isometric view of a pipe shuttle of the system of FIG. 1.

As shown in FIG. 4, the shuttle 60 includes a base 82 and a pair of spaced grips 84*a* and 84*b* mounted to one surface of the base 82 in a spaced relation. A trough 86 is also mounted to the latter surface of the base 82 and extends between the grips 84*a* and 84*b*. Two spaced rollers 86*a* and 86*b* are provided on one side of the base 82 for engaging the rail 62*a*, it being understood that two other rollers (not shown) are provided on the other side for engaging the rail 62*b*. A bumper 88, preferably of a relatively soft material, is disposed at one end of the base 82 for receiving an end of the pipe joint 40.

When a pipe joint 40 is received from either the pipe lift 50 or from the work basket 34, the pipe joint 40 is guided into position on the shuttle 60 by the trough 86, with the bumper 88 providing a lower guide and absorbing some of the downward shock from the pipe joint 40. It is understood that the grips 84*a* and 84*b* are adapted to be actuated to move into and from a position in which they grip the pipe joint 40, in a conventional manner.

Figure 5D:
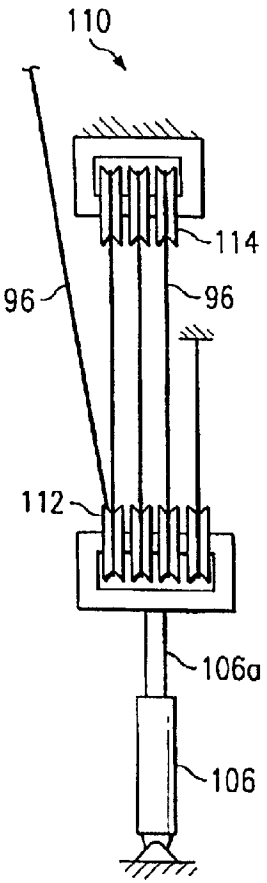
FIGS. 5*c* and 5*d* are diagramatic views of another alternate embodiment of the mechanism of FIG. 5*a*.
Figure 5C:
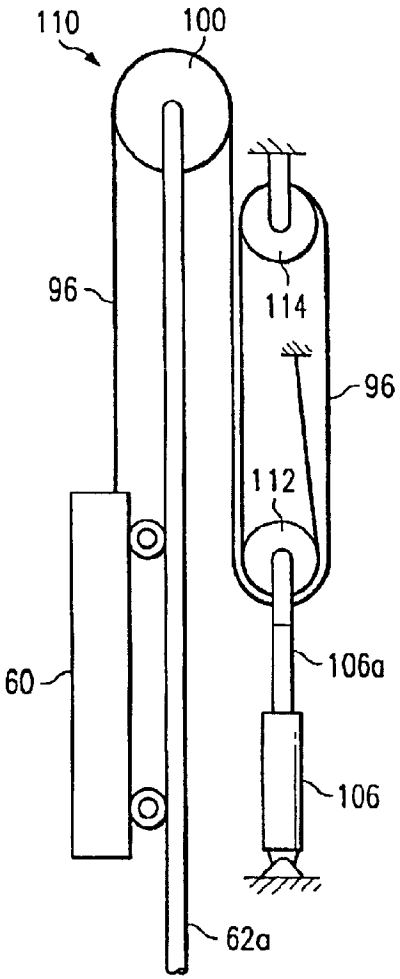
Figure 5B:
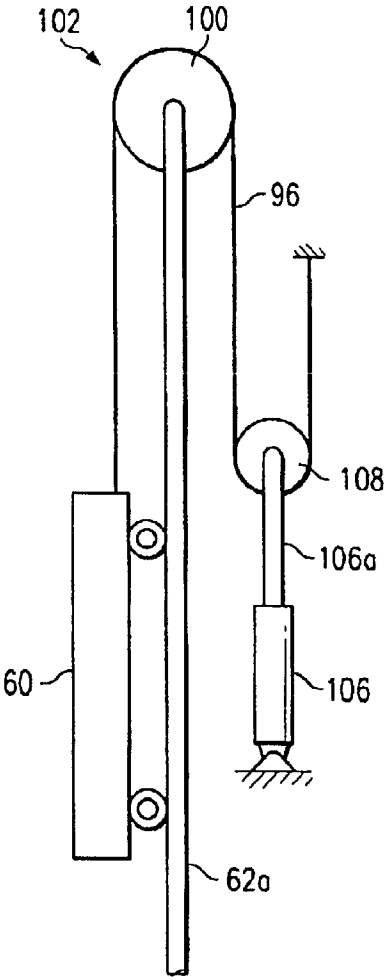
FIG. 5*b* is an diagramatic view of an alternate embodiment of the mechanism of FIG. 5*a*.
Figure 5A:
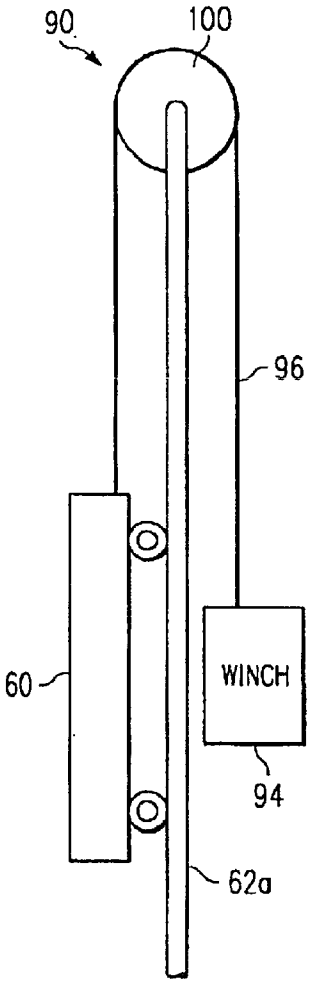
FIG. 5*a* is an diagramatic view of a mechanism for raising and lowering the pipe shuttle of FIG. 4.

One embodiment of a mechanism for moving the shuttle 60 along the rails 62*a* and 62*b* between its lower position and its upper position is shown in detail in FIG. 5*a*. The mechanism is referred to, in general, by the reference numeral 90 and includes a winch 94 and a cable 96 connected between the winch 94 and the shuttle 60 and extending around a pulley 100. The winch 94 is powered in a conventional manner and rotates in one direction to take up the cable 96 and raise the shuttle 60 on the rails 62*a* and 62*b* using the pulley 100, and also rotates in an opposite direction to release the cable 96 and permit the shuttle 60 to be lowered on the rails 62*a* and 62*b* by gravity. Although not shown in FIGS. 1–3 in the interest of clarity, it is understood that the mechanism 90 can be supported by the tower 20 in any conventional manner.

FIG. 5*b* illustrates another embodiment of a mechanism for moving the shuttle 60 along rails 62*a* and 62*b*, which embodiment is referred to in general by the reference numeral 102, and includes several components of the embodiment of FIG. 5*a* which are given the same reference numerals. According to the embodiment of FIG. 5*b*, the winch 94 of the embodiment of FIG. 5*a* is replaced by a hydraulic cylinder 106 including a reciprocal rod 106*a* having a pulley 108 mounted to its distal end. The cable 96 is connected at one end to the shuttle 60, extends around the pulleys 100 and 108, and is connected at its other end to a fixed structure. The hydraulic cylinder 106 can be activated to move the rod 106*a* downwardly in a conventional manner to take up the cable 96 and raise the shuttle 60 on the rails 62*a* and 62*b* using the pulleys 100 and 108, and to move the rod 106*a* upwardly to create slack in the cable 96 so that the shuttle 60 is lowered on the rails 62*a* and 62*b* by gravity. Although not shown in FIGS. 1 and 2 in the interest of clarity, it is understood that the mechanism 102 can be supported by the tower 20 in any conventional manner.

FIGS. 5*c* and 5*d* illustrate another embodiment of a mechanism for moving the shuttle 60 along rails 62*a* and 62*b*, which embodiment is referred to in general by the reference numeral 110 and includes several components of the embodiment of FIG. 5*b* which are given the same reference numerals. According to the embodiment of FIGS. 5*c* and 5*d*, the pulley 108 of the embodiment of FIG. 5*b* is replaced by a set of pulleys 112, and another set of pulleys 114 are mounted to a fixed structure in a spaced relation to the pulleys 112. The cable 96 is connected at one end to the to the shuttle 60, extends around the pulley 100, and is wrapped around each pulley of the set of pulleys 112. The cable 96 then extends to, and is wrapped around, each pulley of the set of pulleys 114, and the other end of the cable is connected to one of the latter pulleys or to a fixed structure. The hydraulic cylinder 106 can thus be activated to move the rod 106*a* downwardly to take up the cable 96 and raise the shuttle 60 on the rails 62*a* and 62*b* using the pulleys 100, 112 and 114. Also, the hydraulic cylinder 106 can be activated to move the rod 106*a* upwardly to create slack in the cable 96 and thus lower the shuttle 60 on the rails 62*a* and 62*b* by gravity. Although not shown in FIGS. 1 and 2 in the interest of clarity, it is understood that the mechanism 110 can be supported by the tower 20 in any conventional manner.

Figure 6:
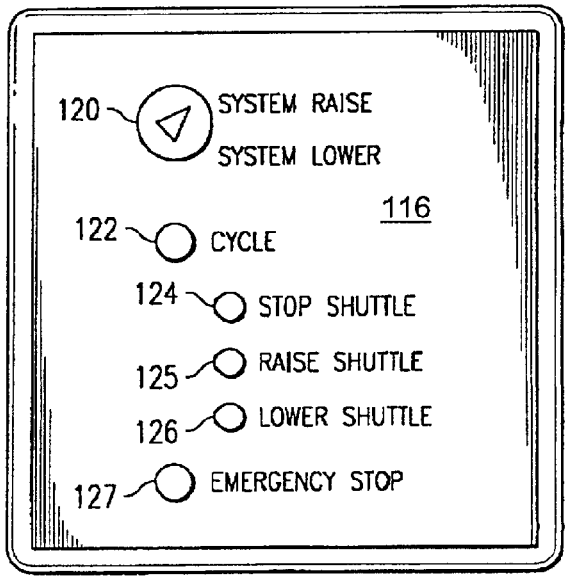
FIG. 6 is a diagrammatic view of a controller used in the system of FIG. 1.

With reference to FIG. 6, a controller 116 is provided to control the operation of the pipe feeder 44, the pipe lift 50, the aforementioned hydraulic cylinder 106 that controls the movement of the pipe lift 50, the shuttle 60, and the mechanism 90 (or 102 or 110). The controller 116 includes a switch 120 to select whether the system 10 raises the pipe joints 40 to, or lowers the pipe joints 40 from, the work basket 34. After the switch 120 is set to a desired position, a control 122 may be selected to cause the system 10 to cycle through the operations described above according to which the pipe joints 40 are either transferred from the rack 42 to the work basket 34, or vice versa. The controller 116 also includes a switch 124 to stop the shuttle 60, a switch 125 to raise the shuttle 60, a switch 126 to lower the shuttle 60, and a switch 127 to cause an emergency stop of the system 10.

Since the electrical components of the controller 116, including the above-mentioned switches, are conventional, the controller will not be described in any further detail.

In operation of the system 10, the controller 116 is provided to a worker on the work basket 34 and, assuming that it is desired to transfer some pipe joints 40 from the rack 42 to the pipe string 30, the switches 120 and 122 are tripped. This activates the motor 70 of the pipe feeder 44 so that it receives a pipe joint 40 from the rack 42, and transfers it to the horizontally disposed pipe lift 50 as described above. The motor 70 then pauses until the pipe lift 50 is ready to receive another pipe joint 40 and the operation is repeated.

The pipe grips 52*a* and 52*b* of the pipe lift 50 are activated to grasp the pipe joint 40, and the above-mentioned hydraulic cylinder 106 is activated to pivot the pipe lift 50 from its horizontal position shown by the solid lines in FIGS. 1–3 to its upright position shown by the phantom lines in FIG. 1 adjacent the tower 20. The pipe grips 52*a* and 52*b* are then released and the grips 84*a* and 84*b* of the shuttle 60 are activated to grip the pipe joint 40.

The mechanism 90 (FIG. 5*a*), is then activated to move the shuttle 60 vertically along the rails 62*a* and 62*b* until it reaches its upper position near the work basket 34. A worker at the work basket 34 receives the pipe joint 40 and attaches a lifting device (not shown) such as a cable operated in conjunction with the mast 32 to the pipe joint 40. The grips 84*a* and 84*b* of the shuttle 60 are released, and the above lifting device raises the pipe joint 40 to allow the bottom of the pipe joint 40 to be attached to the top of the pipe string 30 which is then lowered into the well 22 to allow another pipe joint 40 to be attached. During this movement of the shuttle 60 and the transfer of the pipe joint 40 to the pipe string 30, the pipe lift 50 may be returned to its horizontal position shown in FIG. 1 to begin the next cycle. This cycle can then be repeated for a desired number of pipe joints 40. Of course the above steps can be reversed if it is desired to transfer one or more pipe joints 40 from the pipe string 30 to the rack 42. It is understood that either of the lifting mechanism 102 and 110 (FIGS. 5*b*–5*d*) can be used instead of the mechanism 90 in the above operations.

Alternates and Equivalents

Figure 7:
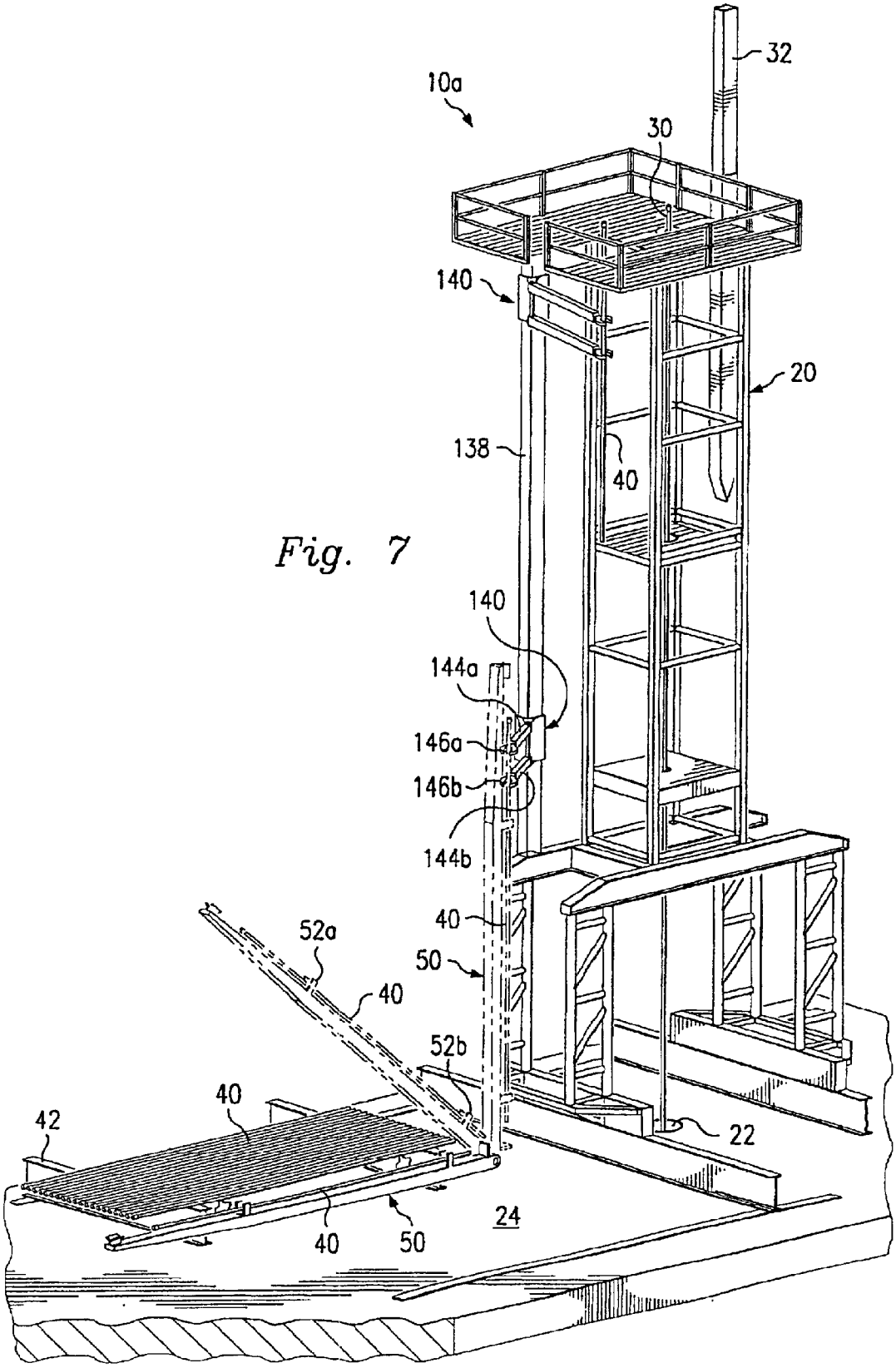
FIGS. 7 and 8 are views similar to FIGS. 1 and 2 respectively, but depicting an an alternate embodiment of the system of the present invention.
Figure 8:
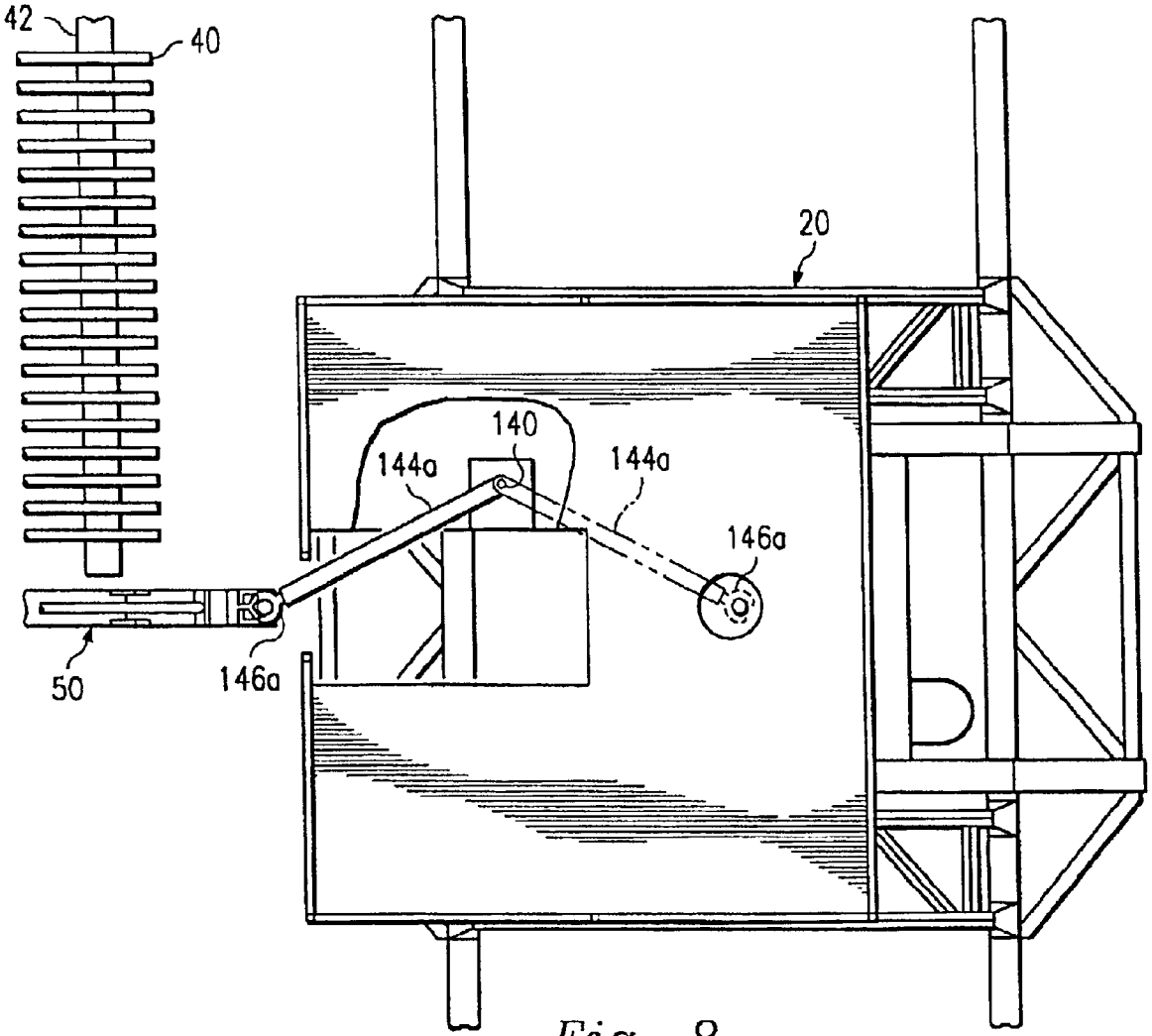

According to the embodiment of FIGS. 7 and 8, a system 10*a* is provided which is similar to the above embodiment and includes many components of the above embodiment which are given the same reference numerals. According to the system 10*a*, the pipe shuttle 60 and the rails 62*a* and 62*b* of the previous embodiment are replaced by a shuttle 140 and a single, upright, rail 138 connected to the tower 20 in any conventional manner. The shuttle 140 is similar to the shuttle 60 with the exception that it includes a pair of arms 144*a* and 144*b*, respectively, that extend radially outwardly from the body of the shuttle 140, as better shown in FIG. 8. The arms 144*a* and 144*b* are adapted to rotate relative to the body of the shuttle 140 in a conventional manner. A pair of grips 146*a* and 146*b* are attached to distal ends of the arms 144*a* and 144*b*, respectively, and are identical to the grips 84*a* and 84*b* of the shuttle 60. It is understood that one of the lifting mechanisms 90, 102, or 110 of FIGS. 5*a*–5*d* can be connected to the shuttle 140 to move it between a lower position and an upper position as shown in FIG. 7 and as described above, With the shuttle 140 in its lower position, the grips 146*a* and 146*b* grasp the pipe joint 40 from the pipe lift 50 after the pipe lift 50 has reached its upright position described in connection with the previous embodiment. After receiving the pipe joint 40 from the pipe lift 50, the lifting mechanism 90, 102, or 110 is activated to raise the shuttle 140 to its upper position. The arms 144*a* and 144*b* are rotated to move pipe joint 40 angularly relative to the body of the shuttle 140 and deliver the pipe joint 40 to the work basket 34 at a point relatively close to the pipe string 30 as shown in connection with the upper position of the shuttle 140. The above operation is reversed to transfer the pipe joints 40 from the pipe string 30 to the pipe lift 50. Otherwise the operation of the system 10*a* is identical to that of the previous embodiment.

Figure 9:
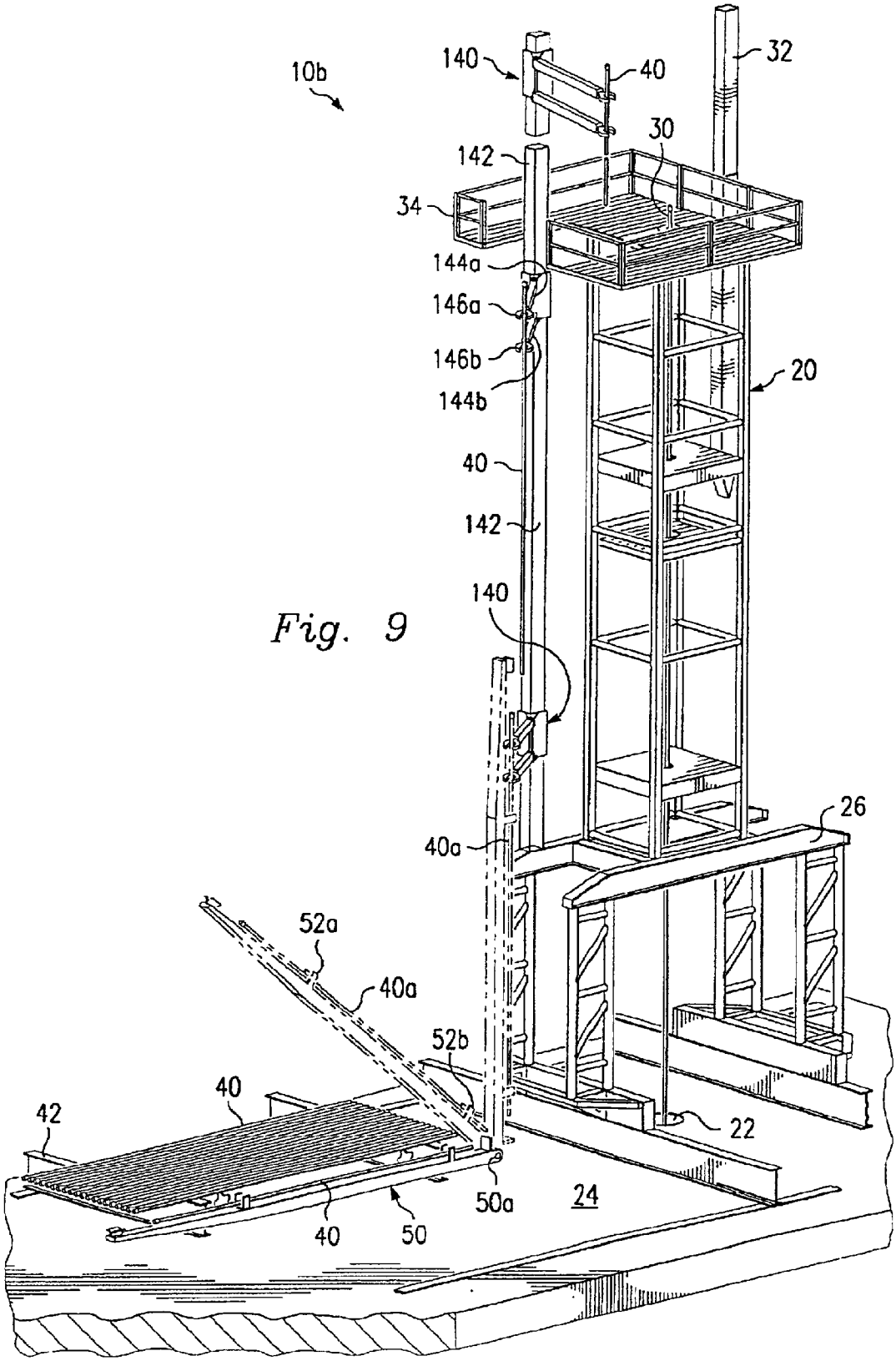
FIG. 9 is a view similar to FIGS. 1 and 7, but depicting another alternate embodiment of the present invention.

According to the embodiment of FIG. 9, a system 10*b* is provided which is similar to the embodiment of FIGS. 7 and 8 and includes many component of the latter embodiment which are given the same reference numerals. According to the system 10*b*, the rail 138 of the embodiment of FIGS. 7 and 8 is replaced by a rail 142 which is identical to the rail 138 with the exception that it extends through, and substantially beyond, the work basket 34. Therefore, the shuttle 140 carrying a pipe joint 40 can be raised to a position above the work basket 34 and the arms 144*a* and 144*b* rotated as described above, to move the pipe joint 40 directly above the pipe string 30 for connection to the pipe string 30 by a worker. Thus, according to this embodiment, the pipe joint 40 may be raised to a position to allow it to be attached to the pipe string 30 without the use of an additional lifting device as discussed in the previous embodiment.

It is understood that other variations may be made in the foregoing without departing from the scope of the invention. For example, the tower 20 can be replaced with other types of towers or support structures. Also, the systems described above can be converted to transfer two or more pipe joints 40 in each cycle. Further, although the controller 116 was described above as being located on the work basket 34, it can be placed in other locations, and can be adapted to communicate with the systems 10 10*a* and 10*b* using wired or wireless devices. Still further, in the embodiments of FIGS. 7–9 the pipe joint 40 may be moved laterally to a position adjacent the work basket 34 in a manner other than that described above.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims.

What is claimed is:

1. A pipe transfer system comprising:

a rack for storing at least one pipe in a substantially horizontal position;

a lift pivotal between a horizontal position in which it receives a pipe from the rack, and a vertical position in which it supports the pipe in a vertical position; and a shuttle for receiving the pipe in its substantially vertical position and moving it to another substantially vertical position spaced from the first-mentioned substantially vertical position.

2. The system of claim 1 further comprising a grip associated with the lift for gripping the pipe during the movement of the lift.

3. The system of claim 1 further comprising a feeder for feeding the pipe from the rack to the lift.

4. The system of claim 3 wherein the feeder comprises a rotatable shaft, and at least one starwheel mounted on the shaft for rotation therewith and adapted to receive the pipe from the rack and transfer it to the lift.

5. The system of claim 1 further comprising a grip associated with the shuttle for gripping the pipe during the movement of the shuttle.

6. The system of claim 1 further comprising at, least one arm associated with the shuttle for gripping the pipe and moving the pipe from the other substantially vertical position to a position spaced angularly from the other substantially vertical position.

7. The system of claim 1 wherein the pipe is adapted to be attached to a pipe string, and wherein the other substantially vertical position is above the upper end of the pipe string.

* * * * *